United States Patent [19]

Schmitt

[11] 4,455,886

[45] Jun. 26, 1984

[54] ADJUSTABLE THERMOSTAT

[75] Inventor: Donald J. Schmitt, Mansfield, Ohio

[73] Assignee: Therm-O-Disc, Incorporated, Mansfield, Ohio

[21] Appl. No.: 321,399

[22] Filed: Nov. 16, 1981

[51] Int. Cl.[3] ..... G05G 5/06

[52] U.S. Cl. ..... 74/531; 74/10.41; 74/553; 200/291

[58] Field of Search ..... 74/531, 527, 553, 10.41; 200/291, 323, 325, 11 J

[56] References Cited

U.S. PATENT DOCUMENTS

| | | | |
|---|---|---|---|
| 3,477,299 | 11/1969 | Speev et al. | 74/10.41 |
| 3,602,863 | 8/1971 | Place | 337/349 |
| 3,877,217 | 4/1975 | Hochstrate | 74/527 X |
| 3,929,093 | 12/1975 | Ikeda | 74/10.41 X |
| 3,943,478 | 3/1976 | Place | 337/347 |
| 4,133,286 | 1/1979 | Linton | 116/313 |
| 4,206,334 | 6/1980 | La Rock | 200/291 |

*Primary Examiner*—Kenneth Dorner

*Assistant Examiner*—Frank McKenzie

*Attorney, Agent, or Firm*—Pearne, Gordon, Sessions, McCoy, Granger & Tilberry

[57] ABSTRACT

An adjustable thermostat is disclosed which has an operating temperature range and in which detent means is provided to establish a plurality of detent positions of a rotatably adjustable shaft for selected operating temperatures of the thermostat. The detent means includes a radially extending, arcuate flange rotatable with the shaft and cooperating with a post on the base. The flange has a plurality of radial notches to establish the plural detent positions in engagement with a projection on the post. The flange is integral with an arcuately extending wall, the wall having inner and outer arcuate surfaces, and the entire wall is deformed and stressed by radial camming action as the shaft is moved from one detent position to another. The foregoing abstract is merely a resume of one general application, is not a complete discussion of all principles of operation or applications, and is not to be construed as a limitation on the scope of the claimed subject matter.

12 Claims, 3 Drawing Figures

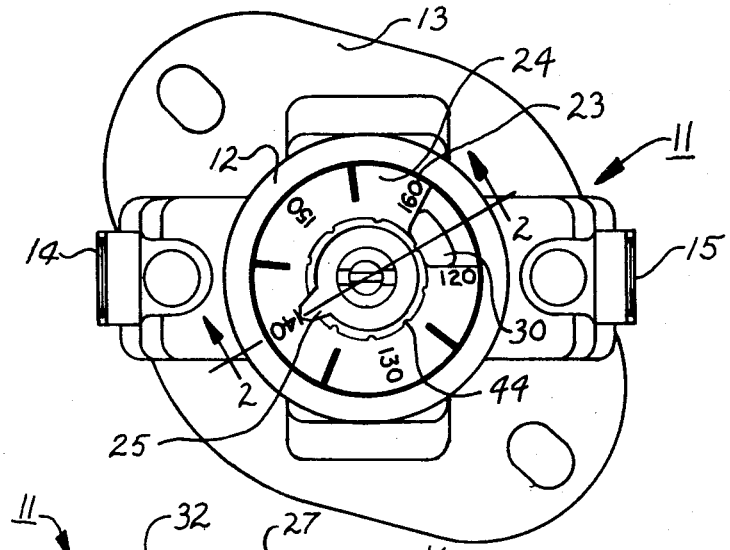
Fig ~ 1
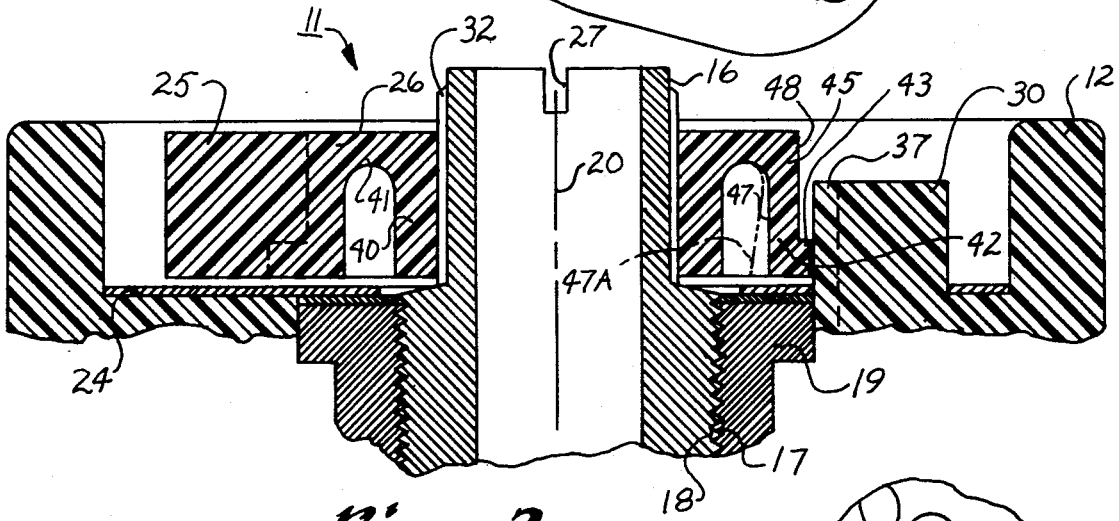
Fig ~ 2
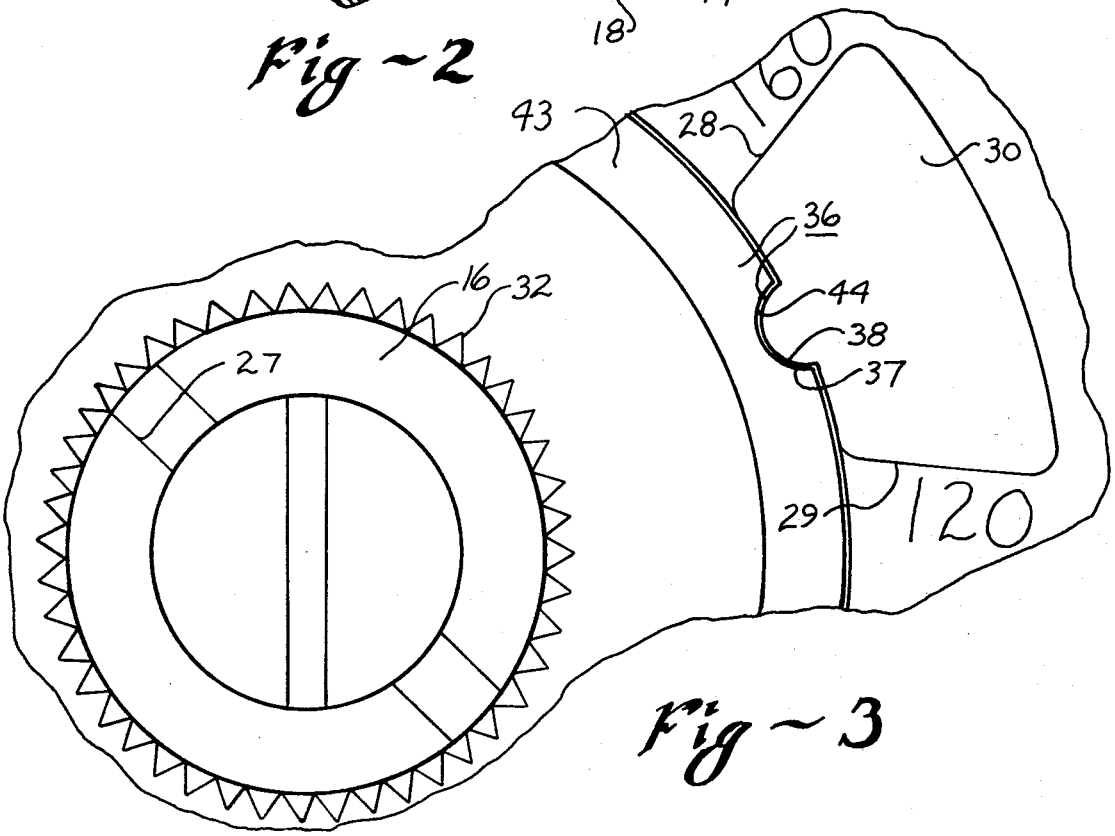
Fig ~ 3

ADJUSTABLE THERMOSTAT

BACKGROUND OF THE INVENTION

The invention relates primarily to adjustable thermostats in which means are provided to adjust the operating temperature of the thermostat, and more particularly to thermostats of this type in which novel and improved detent means provide at least one detent position of the adjustable shaft of the thermostat.

PRIOR ART

Detent mechanisms have been previously used on a number of rotatable shafts. For example, U.S. Pat. No. 3,877,217 shows a detent on the stem of a digital watch, wherein a V-shaped bend in a metal spring engages a radial slot in a disc rotatable with the stem. U.S. Pat. No. 3,477,299 shows a television tuner where a round wire metal spring acts as a detent and is stressed as a torsion spring, and has a bent portion engaging the roots between the crests in a star wheel for detent action. A somewhat similar construction is found in U.S. Pat. No. 3,929,093, wherein a star wheel is engaged by a roller mounted on a shaft carried by a metal spring arm, the roller acting as a detent as it engages the roots between the crests of the star wheel. Some constructions of thermostats have utilized merely a frictional device to resist rotation of the rotatably adjustable shaft of the thermostat, without any true detent action favoring any one particular rotatable position. U.S. Pat. No. 3,602,863 shows such a frictional means to resist movement as being a round spring wire bent so that a bight of a U-bend in the wire frictionally engages a side of the adjusting screw. Another detent on an adjustable thermostat is shown by U.S. Pat. No. 4,133,286, wherein a knob of nylon is mounted on the adjustable shaft and has an elastically deformable, radial flange, with two flats thereon acting as detents by engaging flat, upright posts on the thermostat base. The flange is deformed by the posts as the knob is rotated from a preferred central position of the temperature range.

The problem to be solved, therefore, is how to provide an effective detent means with a long life, yet which is economical in cost of manufacture and assembly and which is capable of providing a plurality of detent positions of the shaft.

SUMMARY OF THE INVENTION

This problem is solved by an adjustable thermostat comprising, in combination, a base, an adjustable shaft mounted for rotation relative to said base about an axis to adjust an operating temperature of the thermostat, detent means including first and second coacting detent members acting between said shaft and said base upon rotation of said shaft, said second detent member including a portion extending in an arc about said axis and coacting with said first detent member, a first radial depression relative to said axis on said arcuate portion angularly adjacent a second radial projection, with one of said depression and projection defining at least one detent position of said shaft, spring means between said arcuate portion and one of said shaft and base, said spring means including a wall extending generally in an arc about said axis and integral with said arcuate portion, said arcuate wall being defined by inner and outer surfaces extending generally in arcs about said axis, and anchor means connected to mount said spring means on one of said shaft and base, said spring means being stressable as said shaft is turned from said at least one detent position to have said arcuate portion cammed radially by engagement with said first detent member to thus deform said arcuate wall and said inner and outer arcuate surfaces.

The problem is further solved by a detent mechanism for an adjustable thermostat having a shaft rotatable relative to a base about an axis to adjust an operating temperature of the thermostat, first and second coacting detent members acting between the shaft and the base upon rotation of the shaft, said second detent member including a portion extending in an arc about said axis and coacting with said first detent member, a first radial depression relative to said axis on said arcuate portion angularly adjacent a second radial projection on one of said detent members with one of said depression and projection defining at least one detent position of said shaft, spring means between said arcuate portion and one of said shaft and base, and anchor means connected to mount said spring means on one of said shaft and base, characterized in that said spring means includes a wall extending generally in an arc about said axis and integral with said arcuate portion, said arcuate wall being defined by inner and outer surfaces extending generally in arcs about said axis, and said spring means being stressable as said shaft is turned from said at least one detent position to have said arcuate portion cammed radially by engagement with said first detent member to thus deform said arcuate wall and said inner and outer arcuate surfaces.

Accordingly, an object of the invention is to provide a detent means for an adjustable thermostat which is both economical and reliable.

Another object of the invention is to provide a detent means for an adjustable thermostat wherein an arcuate wall is radially cammed and deformed, and hence stressed as a spring between detent positions of the shaft.

Another object of the invention is to provide a detent means which is integral with an indicator knob and requires no additional parts.

Other objects and a fuller understanding of the invention may be had by referring to the following description and claims, taken in conjunction with the accompanying drawings.

BRIEF DESCRIPTION OF THE DRAWINGS

FIG. 1 is an enlarged plan view of a thermostat embodying the invention;

FIG. 2 is a sectional view on line 2—2 of FIG. 1 to an enlarged scale; and FIG. 3 is an enlarged plan view of part of the thermostat of FIG. 1.

DESCRIPTION OF THE PREFERRED EMBODIMENT

FIGS. 1–3 illustrate an adjustable thermostat 11 which includes a base 12. This base is preferably rigid and preferably made from an insulating material such as a rigid molded plastic. A mounting flange 13, for example of metal, is rigidly attached to and extends from the base 12 to provide for mounting the thermostat. The thermostat has first and second terminals 14 and 15, which are connected internally to the thermostatically actuated switch. The internal structure of such thermostat is disclosed in U.S. Pat. No. 3,943,478, and such patent is incorporated herein by reference for such disclosure. It should be understood that the present invention is not limited to the particular thermostat illustrated in such patent but is equally applicable to other types and structures of thermostats.

An adjustable shaft 16 is rotatable in the base 12 for the purpose of adjusting an operating temperature of the thermostat 11. This adjustable shaft is rotatably mounted in some manner, and in the preferred embodiment the shaft is of metal and is provided with threads 17 to cooperate with threads 18 on a metal bushing 19 secured in the base 12. The rotation of the shaft 16 may act through a cam to provide adjustment of an operating temperature; however, in this preferred embodiment, the provision of these threads 17,18 establishes that, as the shaft 16 is rotated, it also moves along the axis 20 to establish this adjustability.

The thermostat 11 has an adjustable temperature range of operation and temperature indicia are provided on this thermostat. This temperature indicia may rotate with the shaft 16 and cooperate with a fixed index mark; however, in this preferred embodiment the temperature indicia 23 are provided on a dial plate 24 which is fixed on the base 12. A pointer 25 cooperates with the temperature indicia 23 to indicate the operating temperature, and this pointer is on a knob 26 which is secured to the shaft 16 to rotate with this shaft. FIG. 1 is drawn to a scale enlarged from the actual thermostat in which this invention has been embodied, and the knob 26, therefore, may actualy be too small for easy manipulation, so a screwdriver slot 27 may be provided in the exposed end of the shaft 16 in order to rotate the shaft.

The rotation of the shaft 16 adjusts the thermostat through at least a part of the operating temperature range of this thermostat, and means is provided to limit the adjustable temperature range. An upper limit is provided by a stop surface 28 and a lower limit provided by a stop surface 29. Conveniently in this preferred embodiment, both the stop surfaces 28 and 29 are provided on a single post 30 which is upstanding from the base 12, and these stop surfaces cooperate with the pointer 25, which performs the double function of temperature indication and a temperature range limit stop.

The knob 26 is preferably made from an elastic material, such as a type of nylon. This knob as manufactured has an internal aperture which is cylindrical and is pressed over a knurled portion 32 on the exposed end of the shaft 16. In this manner, the knob is secured to the shaft for common rotation.

The adjustable thermostat 11 includes detent means 36 acting between the rotatable shaft 16 and the base 12. This detent means includes a first detent member 37 and a second detent member 38. This detent means 36 provides at least one detent position of the shaft 16 relative to the base 12 and, in a preferred embodiment, provides a possibility of a plurality of such detent positions.

The second detent member 38 is carried on and, in fact, is part of the knob 26. The knob 26 includes an anchor wall 40, a radially extending wall 41, an outer, arcuate wall 42, and a radially extending flange 43. The radially extending flange 43 is that which provides the second detent member 38, and in this preferred embodiment includes one or more notches 44 which are adapted to cooperate with the first detent member 37 which is a projection on the post 30 parallel to the axis 20. If a plurality of such notches 44 are provided, then this provides a plurality of detent positions of the shaft. The elasticity of the material from which the knob 26 is manufactured provides a spring means 45 for the detent means 36, and this spring means 45 is principally the elastic deformation of the arcuate wall 42 and, to some extent, the elastic deformation of the radially extending wall 41. It will be noted that the radially extending wall 41, together with the arcuate wall 42, are generally L-shaped in cross section, as viewed in FIG. 2, and the combination of the anchor wall 40, radially extending wall 41, and arcuate wall 42 is generally U-shaped in cross section, as viewed in FIG. 2. This elastic deformation takes place when the shaft 16 is rotated out of the position shown in FIGS. 1 and 3 because the projection 37 on the post 30, which is the first detent member, radially cams the flange 43 to deform the wall 42 inwardly as the shaft 16 is rotated between detent positions established by two adjacent notches 44.

In operation, the adjustable thermostat 11 may be adjusted to an operating temperature thereof by rotating the knob 26 or utilizing a screwdriver, for example, in the slot 27. In either case, this will rotate the shaft 16. Through mechanism not shown, this internally adjusts the operating temperature of the thermostat 11. In the preferred embodiment, the rotation of this shaft 16, via the threads 17 and 18, provides a small axial movement to the shaft 16 to effect this temperature adjustment. The detent means 36 is provided in the thermostat 11 without any parts in addition to the parts normally used for the thermostat. The knob 26 carries the pointer 25 to cooperate with the temperature indicia 23 to indicate the selected operating temperature. At least one, and preferably a plurality of detent positions, are provided by the several notches 44. The knob 26 is made from some elastic insulating material such as nylon, and is easily pushed onto the knurls 32 of the shaft 16 to be gripped by such knurls for rotation with the shaft. Regardless of how far down it is pushed, within limits, the thickness of the radial flange 43 always cooperates in the same way with the projection 37 on the post 30 to have consistent detent action.

As the knob 26 and shaft 16 are rotated away from a given detent position as shown in FIG. 3, the coaction of the first and second detent members 37 and 38 cams the radial flange 43 radially inwardly to stress the spring means 45. In the preferred embodiment shown, this spring means is primarily the arcuate wall 42, and this wall has an inner arcuate surface 47 and an outer arcuate surface 48. As shown by the dot-dash line in FIG. 2, the inner arcuate surface 47 is deformed to a position 47A when the radial flange 43 is cammed radially inwardly upon being moved away from a given detent position. The radial flange 43 actually acts as a stiffening flange to stiffen the lower edge of this arcuate wall 42, and thus the stressing of this arcuate wall 42 takes place over a larger arc than merely an area immediately adjacent the particular notch 44. In fact, in the embodiment shown, this arcuate wall 42 is generally cylindrical and the flange 43 is a completely circular flange except for where it merges with the pointer 25, so this combination considerably stiffens this wall 42. The spring means 45 also may be considered to include the radially extending wall 41, which also is stressed whenever the flange 43 is cammed radially inwardly during movement between detent positions of the knob 26. The anchor wall 40 may be considered an anchor means which is connected to mount the spring means 45 on one of the shaft and the base. In the preferred embodiment, it is mounted on the shaft 16. The one or more notches 44 may be considered first radial depressions relative to the axis 20, and these notches alternate with and are adjacent to second radial projections on one of the detent members. In the preferred embodiment, these notches are on the second detent member 38, with the first detent member 37 being on the base. The second radial projections are those portions of the radial flange 43 which are not cut away by the notches 44. The radial flange 43 may be considered to be a portion of the second detent member 38 which is extending in an arc about the axis 20.

The stiffness imparted to the wall 42 by the radially extending flange 43 permits lightweight construction. In one actual embodiment of a thermostat, the knob 26 had an outside diameter of 0.300 inch, the wall 42 had a thickness of 0.020 inch, and a length in the axial direction of 0.090 inch. The radially extending wall 41 had a thickness in the direction of the axis 20 of 0.030 inch and the radial flange had a thickness in the axial direction of 0.025 inch and a radial dimension of 0.023 inch. The material used was Zytel. It will be noted that the knob 26 is made without any re-entrant surfaces; hence, it may be molded in a simple two-part mold. Also, the insulating base 12 has no re-entrant surfaces, so it also may be made in a simple two-part mold. These two parts—the knob 26 and base 12—provide, as integral parts thereof (and in fact as unitary parts) the first and second detent members 37 and 38. Accordingly, the detent means assembles automatically with the assembly of the thermostat 11, and the detent means 36 has a long life because of the relatively easy flexing and stressing of the wall 42 as the shaft is turned between detent positions. The spring means 45 is not stressed beyond its elastic limit, so it has a long life. The projection 37 is round in cross section, as viewed in FIG. 3, and may have a radius of 0.016 inch to cooperate with a substantially similar radius of the notches 44. This rounded projection easily cams the second detent member 38 radially inwardly during movement between detent positions without tearing the material of the radial flange 43, and this also promotes long life of the detent means 36.

The invention provides a detent mechanism which has an arcuate portion integral with an arcuate wall, and this arcuate portion has a first radial depression relative to the shaft axis which is angularly adjacent a second radial projection, and either the depression or the projection defines at least one detent position of the shaft. When the mechanism is in the detent position, as shown in FIG. 3, a slight rotation of the shaft 16 causes the first detent member 37 to engage the second radial projection on the radially extending flange 43, which deforms the arcuate wall 42 as the principal part of the spring means 45. As the shaft is rotated between detent positions, the first detent member 37 frictionally engages the edge of the radial flange 43 for a frictional engagement between the shaft 16 and the base 12, with this frictional engagement resisting free rotation of the shaft. As the first detent member 37 drops into the next notch on the flange 43, the arcuate wall 42 is no longer stressed, and it resumes its unstressed position as shown in FIG. 3. The stressing of the arcuate wall 42 is a form of stressing as a cantilever beam, as viewed in the sectional view of FIG. 2.

The present disclosure includes that contained in the appended claims, as well as that of the foregoing description. Although this invention has been described in its preferred form with a certain degree of particularity, it is understood that the present disclosure of the preferred form has been made only by way of example, and that numerous changes in the details of construction and the combination and arrangement of parts may be resorted to without departing from the spirit and the scope of the invention as hereinafter claimed.

What is claimed is:

1. An adjustable thermostat comprising, in combination:

a base;

a shaft mounted for rotation relative to said base about an axis to adjust an operating temperature of the thermostat;

detent means including first and second coacting detent members acting between said shaft and said base upon rotation of said shaft;

said second detent member including a portion extending in an arc about said axis and coacting with said first detent member;

a first radial depression relative to said axis on said arcuate portion angularly adjacent a second radial projection, with one of said depression and projection defining at least one detent position of said shaft;

spring means between said arcuate portion and one of said shaft and base;

said spring means including a first arcuate wall extending generally in an arc about said axis and integral with said arcuate portion;

said first arcuate wall being defined by inner and outer surfaces extending generally in arcs about said axis;

anchor means connected to mount said spring means on one of said shaft and base;

said spring means including a radially extending wall integral with said first arcuate wall;

said anchor means including a second arcuate wall connected to said radially extending wall for a U-shaped cross section of said radially extending wall and arcuate walls; and said spring means being stressable as said shaft is turned from said at least one detent position to have said arcuate portion cammed radially by engagement with said first detent member to thus deform said first arcuate wall and said inner and outer arcuate surfaces.

2. An adjustable thermostat as set forth in claim 1, wherein said spring means is unitary with said arcuate portion.

3. An adjustable thermostat as set forth in claim 1, wherein said anchor means is connected to mount said spring means on said shaft.

4. An adjustable thermostat as set forth in claim 1, wherein said arcuate portion is a generally cylindrical wall.

5. An adjustable thermostat as set forth in claim 1, wherein said arcuate wall is unitary with said first arcuate portion.

6. An adjustable thermostat as set forth in claim 5, wherein said first and second detent members coact during rotation of said shaft to stress said spring means in an amount less than the elastic limit to establish a long life of said detent means.

7. An adjustable thermostat as set forth in claim 1, wherein said second arcuate wall is mounted on said shaft.

8. A detent mechanism for an adjustable thermostat having a shaft rotatable relative to a base about an axis to adjust an operating temperature of the thermostat, first and second coacting detent members acting between the shaft and the base upon rotation of the shaft, said second detent member including a portion extending in an arc about said axis and coacting with said first detent member, a first radial depression relative to said axis on said arcuate portion angularly adjacent a second radial projection with one of said depression and projection defining at least one detent position of said shaft, spring means between said arcuate portion and one of said shaft and base, and anchor means connected to mount said spring means on one of said shaft and base, characterized in that said spring means includes a first arcuate wall extending generally in an arc about said axis and integral with said arcuate portion;

said first arcuate wall being defined by inner and outer surfaces extending generally in arcs about said axis;

said spring means including a radially extending wall integral with said first arcuate wall;

said anchor means including a second arcuate wall connected to said radially extending wall for a U-shaped cross section of said radially extending wall and arcuate walls; and said spring means being stressable as said shaft is turned from said at least one detent position to have said arcuate portion cammed radially by engagement with said first detent member to thus deform said arcuate wall and said inner and outer arcuate surfaces.

9. A detent mechanism as set forth in claim 8, wherein said first arcuate wall is an annular wall.

10. A detent mechanism as set forth in claim 8, wherein said first arcuate wall is unitary with said arcuate portion.

11. A detent mechanism as set forth in claim 8, wherein said spring means includes a generally radially extending wall integral with said arcuate wall.

12. A detent mechanism as set forth in claim 8, wherein said first arcuate wall is stressed as a cantilever beam during shaft movement from the detent position.

* * * * *

UNITED STATES PATENT AND TRADEMARK OFFICE

CERTIFICATE OF CORRECTION

PATENT NO. : 4,455,886

DATED : June 26, 1984

INVENTOR(S) : Donald J. Schmitt

It is certified that error appears in the above-identified patent and that said Letters Patent are hereby corrected as shown below:

Column 3, line 29, "actualy" should read "actually".

Claims

Claim 5, column 6, line 54, "first" should be inserted after "said" in first occurrence.

Claim 5, column 6, line 54, "first" should be deleted after "said" in second occurrence of the word.

Signed and Sealed this

*Twenty-third* Day of *October 1984*

[SEAL]

*Attest:*

GERALD J. MOSSINGHOFF

*Attesting Officer*

*Commissioner of Patents and Trademarks*